United States Patent [19]

Yamada et al.

[11] Patent Number: 4,737,727

[45] Date of Patent: Apr. 12, 1988

[54] CHARGED BEAM APPARATUS

[75] Inventors: Tadatoshi Yamada; Shiro Nakamura; Takafumi Nakagawa; Yuuichi Yamamoto, all of Hyogo, Japan

[73] Assignee: Mitsubishi Denki Kabushiki Kaisha, Tokyo, Japan

[21] Appl. No.: 13,816

[22] Filed: Feb. 12, 1987

[30] Foreign Application Priority Data

| | | | |
|---|---|---|---|
| Feb. 12, 1986 | [JP] | Japan | 61-28450 |
| Feb. 19, 1986 | [JP] | Japan | 61-34405 |
| Apr. 14, 1986 | [JP] | Japan | 61-86632 |

[51] Int. Cl.[4] ..... H05H 13/04; H01F 7/22

[52] U.S. Cl. ..... 328/235; 313/62; 335/216

[58] Field of Search ..... 328/227, 228, 229, 230, 328/235; 313/62; 335/210, 216

[56] References Cited

U.S. PATENT DOCUMENTS

| | | | |
|---|---|---|---|
| 4,641,057 | 2/1987 | Blosser et al. | 328/235 X |
| 4,680,565 | 7/1987 | Jahnke | 328/235 X |

*Primary Examiner*—David K. Moore
*Assistant Examiner*—Sandra L. O'Shea
*Attorney, Agent, or Firm*—Sughrue, Mion, Zinn, Macpeak & Seas

[57] ABSTRACT

A charged beam apparatus comprises vacuum vessels for accommodating superconducting coils in a heat-insulating manner, a charged beam vacuum chamber that provides a passage for a charged beam, and a vacuum chamber for synchrotron radiation that is coupled to the charged beam vacuum chamber and through which is passed the synchrotron radiation that is produced by the charged beam when it is bent by the superconducting coils, the vacuum vessels being detachable from the charged beam vacuum chamber.

8 Claims, 7 Drawing Sheets

CHARGED BEAM APPARATUS

BACKGROUND OF THE INVENTION

The present invention relates to a charged beam apparatus such as a synchrotron or a storage ring which accelerates a charged beam such as an electron beam, stores the accelerated beam and utilizes the synchrotron radiation that is generated at the beam bending portions. More particularly, the present invention relates to an improvement of a cryogenic vessel for a charged-beam deflection superconducting magnet (this vessel is hereinafter sometimes referred to as a cryostat), as well as to a technique for shielding leakage flux and correcting the distribution of deflection magnetic field.

FIG. 1 shows schematically the operating principles of a storage ring 100. In the Figure, reference numeral 1 designates a vacuum chamber for providing a passage for a charged beam, 2 a vacuum chamber for guiding synchrotron radiation, 3 a deflection magnet for bending the charged beam, 4 synchrotron radiation, 5 a vacuum chamber for guiding the charged beam into the storage ring, and 6 the charged beam. The apparatus and components that do not have any direct relation to the present invention are not shown in FIG. 1.

In the actual apparatus, the vacuum chamber 1 for charged beam passing through the deflection magnet 3 is provided with a plurality of vacuum chambers 2 for synchrotron radiation that are slightly staggered in position one to another. For the sake of clarity, FIG. 1 shows the use of a single vacuum chamber 2 for one deflection magnet 3.

The operation of the storage ring 100 will proceed as follows. A charged beam (typically an electron beam) 6 accelerated close to the velocity of light is injected into the storage ring 100, and the beam travels through a circle of vacuum chambers 1 as it is deflected by deflection magnets 3. When the beam 6 is deflected by a deflection magnet 3, synchrotron radiation 4 is generated in a direction tangential to the beam's orbit. This radiation has a broad spectrum ranging from soft X-rays to visible light and provides a superior radiation source.

The intensity of synchrotron radiation 4 is proportional to the charged beam current which in turn is proportional to the quantity of charged beam in the storage ring. In order to increase the charged beam current, the pressure in the vacuum chambers for charged beam, which are connected to the vacuuum chambers for synchrotron radiation, must be reduced to an extreme high vacuum, which typically is within the range of $10^{-9}$ to $10^{-10}$ Torr. An ultrahigh vacuum of the same order is also required for prolonging the life time of charged beam. If a sufficient vacuum is not produced, the charged beam will collide with the gas molecules or ions in the vacuum chambers to attenuate the charged beam current. As a result, neither the charged beam current nor the life time of the charged beam can be increased; in other words, synchrotron radiation of high intensity cannot be produced for a long period of time.

FIG. 2 shows a typical coil winding for a superconducting magnet used as a deflection magnet, with the direction of current flow being indicated by the arrows. The coils shown in FIG. 2 are placed in a cryostat to make a superconducting deflection magnet. FIG. 3 shows in cross section the construction of a conventional superconducting deflection magnet such as the one described in "IEEE TRANSACTION OF MAGNETICS", vol. MAG-15, No. 1, JAN., 1979, pp. 131-133.

In FIG. 3, reference number 31 designates a superconducting coil, 32 a coil support structure, 33 liquid helium for cooling the coil 31, 34 a helium container (vacuum-resistant), 35 a heat insulating vacuum space (which typically is evacuated to a pressure of about $10^{-6}$ Torr), 36 heat shielding liquid nitrogen, 37 a nitrogen container (also vacuum-resistant), and 38 a vacuum vessel. A vacuum chamber 1 for charged beam also serves as an inner vacuum vessel for the magnet. An example of the direction of a deflecting magnetic field for deflecting the charged beam is indicated by the arrow. Although not shown, a spacer for retaining a gap is disposed between individual structural components.

An application of the conventional superconducting deflection magnet to a storage ring is shown schematically in FIG. 4, wherein synchrotron radiation is extracted through a vacuum chamber 2 provided on the side of the vacuum vessel 38. The vacuum chamber 2 which also serves as the inner vacuum chamber for the magnet is connected to the vacuum vessel 38 in a vacuum-resistant manner. In the case shown, the superconducting coil is divided into two sections, upper and lower, which are sufficiently spaced from each other to accommodate the vacuum chamber 2 for synchrotron radiation.

Having the construction described above, the conventional superconducting deflection magnet has one major problem: the ultrahigh vacuum ($10^{-9}$ to $10^{-10}$ Torr) in the vacuum chambers for charged beam and synchrotron radiation are connected to the heat-insulating vacuum (about $10^{-6}$ Torr) in the cryostat by the same vacuum wall (i.e., vacuum chambers 1 and 2 in FIGS. 3 and 4), so if the ultrahigh vacuum is deteriorated and it becomes necessary to repair or replace the vacuum chamber for charged beam or synchrotron radiation, the cryostat must also be disassembled. Since high level techniques are required to attain an ultrahigh vacuum in the range of $10^{-9}$ to $10^{-10}$ Torr, the probability that the ultrahigh vacuum will be deteriorated during operation of the storage ring would be considerably higher than the probability of deterioration in the heat-insulating vacuum in the cyostat.

FIG. 5 shows a charged beam apparatus of the type described in "Superconducting Racetrack Electron Storage Ring and Coexistent Injector Microtron for Synchrotron Radiation", by T. Miyahara, K. Takata and T. Nakanishi, TECHNICAL REPORT of ISSP, Ser B No. 21, 1984. In the Figure, reference numeral 51 designates a septum magnet for injecting charged particles into a storage ring, 52 superconducting coils forming a superconducting magnet, 53 an iron yoke, 54 a quadrupole magnet, 55 kicker magnet, 56 radio-frequency cavity, 57 a sectupole magnet, 58 a monitor, 59 an octupole magnet, 60 a vacuum pump, 61 a synchrotron radiation port, and 64 a vacuum chamber.

The operation of the apparatus shown in FIG. 5 will be described. Charged particles accelerated to a sufficient speed are bent with the septum magnet 51 and guided into the ring. The injected particles are then adjusted with the quadrupole magnet 54, sextupole magnet 57 and octupole magnet 59 to keep moving along predetermined orbits. When the travelling direction of the particles is bent with the magnetic field of the superconducting coils 52, synchrotron radiation is produced in a direction tangential to the orbit of the particles. The energy lost by emission of the synchrotron radiation is compensated in the radio-frequency cavity 56 and this provides sufficient energy for the charged particles to continuously travel through the ring. The emitted synchrotron radiation is guided to the outside by way of the synchrotron radiation port 61 and utilized as a radiation source.

The superconducting coils 52 used in the apparatus of FIG. 5 have a uniform and very strong magnetic field of about 4[T]. In comparison, the quadrupole magnet 54, sextupole magnet 57 and octupole magnet 59 have weak fields of about 1.4[T]. The deflection radius $\rho$, the energy of charged particles E, and the deflection field B created by the superconducting coils 52 can be correlated by $B=E/0.3\rho$. If, for instance, the stored energy E is increased with a view to extracting more intense synchrotron radiation, or if $\rho$ is decreased in order to reduce the overall size of the equipment, B will increase progressively to such an extent that the necessary amount of B cannot be supplied by a normal conducting magnet and can only be attained by the superconducting coils 52. However, the strong field of the superconducting magnet causes magnetic saturation or nonuniformity of magnetic field, which leads to an increased leakage flux at the ends of the coils. The excessive leakage flux will either impair the fields of nearby magnets or impart an unwanted magnetic field to the charged particles.

In short, the conventional charged beam apparatus having the construction described above has the following problems: if the deflecting magnetic field is increased, more leakage flux will occur to impair the uniformity of the fields of magnets located in the neighborhood of the deflection magnet; in addition, the charged particles travelling on predetermined orbits are subjected to the action of unwanted fields and become unstable within the ring, and they will thus vanish as a result of collision against the ring wall. The problem of leakage flux will become more pronounced if a progressively stronger deflecting field is required in such cases as when one wants to obtain strong radiation or reduce the overall size of the equipment.

FIGS. 6(*a*) and 6(*b*) show still another example of the conventional charged beam apparatus. An ultrahigh vacuum chamber 71 through which a charged beam travels and which is evacuated to a pressure of the order of $10^{-9}$ Torr (this chamber is hereinafter referred to simply as a vacuum chamber) consists of a plurality of straight sections 71*a* in which the charged beam travels on a straight line and an equal number of sections 71*b* in which the beam is deflected. A deflection electromagnet 72 is formed of superconducting deflection coils 73 (which are hereinafter referred to as superconducting coils) and disposed in each of the deflecting sections 71*b*. An equilibrium orbit 74 for the charged beam is formed within the vacuum chamber 71. A charged beam region 75 represents the area of spatial location where the charged beam exists. The charged beam is injected into the system at entrance 76.

The operation of the system of FIG. 6 will be described. After being injected into the vacuum chamber 71 through entrance 76, the charged beam will keep moving along the predetermined orbit 74 formed by the deflection electromagnet 72. If the system is used as an electron storage ring, the charged beam will produce synchrotron radiation when its orbit is bent and the resulting radiation is extracted for further use. A cross section of the beam in the vacuum chamber 71 has a certain amount of spread to form the charged beam region 75. In other words, the charged beam consists of particles that continue to move on the orbit 74 while experiencing small oscillations. It is therefore necessary to impart a predetermined deflecting magnetic field to the entire part of the charged beam region. If the beam is subjected to varying amounts of deflecting field in different positions of the beam region 75, it becomes impossible to confine the beam in the region 75 and the charged particles will collide against the wall of the vacuum chamber 71 to gradually lose their energy. Various efforts and proposals have therefore been made in order to provide a deflecting magnetic field having a maximum degree of uniformity throughout the charged beam region 75.

If the deflection electromagnet is composed of normal conducting coils, the use of an iron yoke will provide a uniform field fairly easily. On the other hand, the use of superconducting coils 73 has been proposed with a view to producing a stronger magnetic field and achieving reduction in the overall size of equipment. However, if an iron yoke is used with superconducting coils it must be accommodated in a cryostat and problems will occur in association with heat load and support mechanism, which leads to an increase in the overall size of the deflection magnet or in the cooling cost. If no iron yoke is used as in the conventional case shown in FIGS. 6(*a*) and 6(*b*), the deflection magnet is not capable of producing a uniform field in the radial direction of the beam region 75 and will suffer from unwanted beam accumulation and reduced beam life time.

SUMMARY OF THE INVENTION

The present invention has been accomplished in order to solve the aforementioned problems of the prior art. An object, therefore, of the present invention is to provide a charged beam apparatus that permits vacuum chambers to be repaired or replaced without disassembling the cryostat. Another object of the present invention is to provide a charged beam apparatus in which the leakage flux in the field of a deflection magnet is blocked so that it will not impair the uniformity of the field of nearby magnets. A further object of the present invention is to provide a charged beam apparatus that produces a uniform distribution of deflecting field in its radial direction.

The first object of the present invention can be attained by a charged beam apparatus wherein the vacuum vessel is separated both from a vacuum chamber for charged beam and from a vacuum chamber for synchrotron radiation. Separation between these components is achieved by the following mechanism: an upper and a lower coil are placed in separate liquid helium containers and are coupled by cryogenic support members; the vacuum vessel is also divided into an upper and a lower section and are provided with through-holes only in the areas where the cryogenic support members are installed; expansion joints are provided at these through-holes to couple the two sections of vacuum vessel.

The second object of the present invention is attained by a charged beam apparatus that has a shield provided at both ends of a deflection electromagnet in order to block any leakage flux coming from said magnet.

The third object of the present invention is attained by a charged beam apparatus that employs superconducting coils for deflecting a charged beam and which provides a magnetic piece both above and below a vacuum chamber or in a partial area of the vacuum chamber itself for the purpose of effecting local correction of the field distribution provided by the superconducting coils.

In accordance with the first aspect of the present invention, the upper and lower coils are coupled by cryogenic support members provided in the outside of liquid helium containers, and the upper and lower section of the vacuum vessel are coupled by expansible vacuum joints at the sites where the cryogenic support members penetrate through those sections. This construction has the advantage that if deterioration of ultra-high vacuum occurs either in the vacuum chamber for charged beam or in the vacuum chamber for synchrotron radiation, the magnet can be readily disassembled by separating the upper and lower coils and this provides for easy repair or replacement of the two types of vacuum chamber.

In accordance with the second aspect of the present invention, a shield is provided at both ends of the deflection electromagnet so as to block any leakage flux coming from the magnet. The shield is effective not only in preventing the leakage flux of the deflection magnet from impairing the uniformity of the fields of nearby magnets but also in enabling the charged particles to keep moving along their orbits in the ring without being upset by unwanted magnetic fields.

In accordance with the third aspect of the present invention, a magnetic piece is provided for the purpose of correcting the field distribution of the deflection electromagnet. This magnetic piece serves to provide a uniform field throughout the region where the charged beam exists, thereby preventing a reduction in the life time of charged beam. In addition, the use of such magnetic pieces enables the production of a charged beam apparatus that is lighter in weight, smaller in size and which receives a smaller amount of heat than the prior art system using an iron yoke.

BRIEF DECRIPTION OF THE DRAWINGS

Figure 6A:
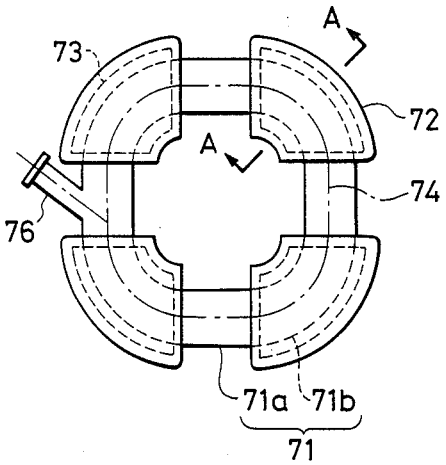
FIG. 6(a) PRIOR ART
Figure 6B:
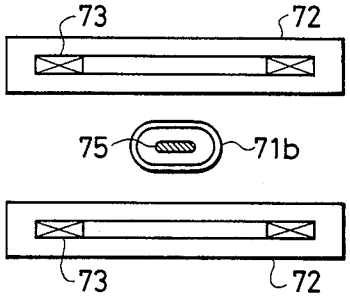
FIG. 6(b) PRIOR ART
Figure 7:
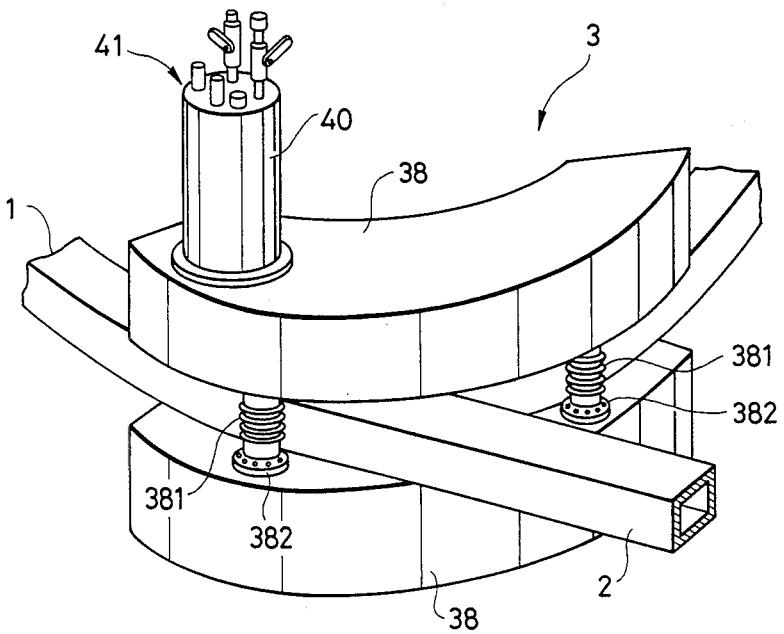
Figure 9C:
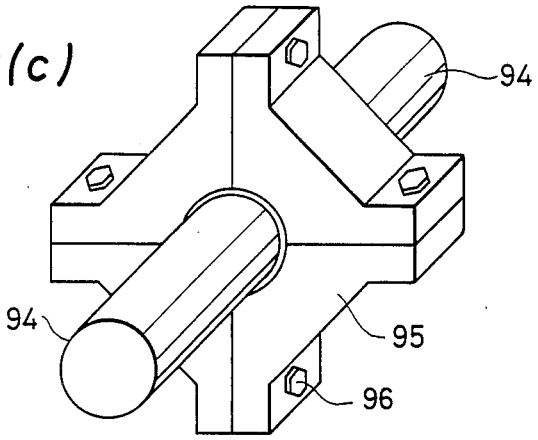
Figure 10:
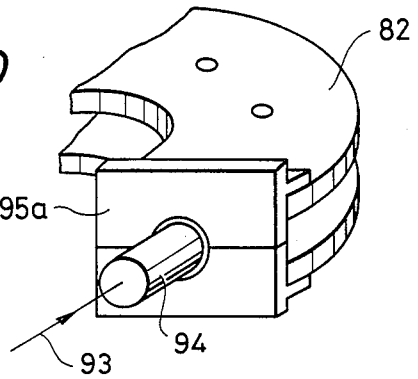
Figure 11A:
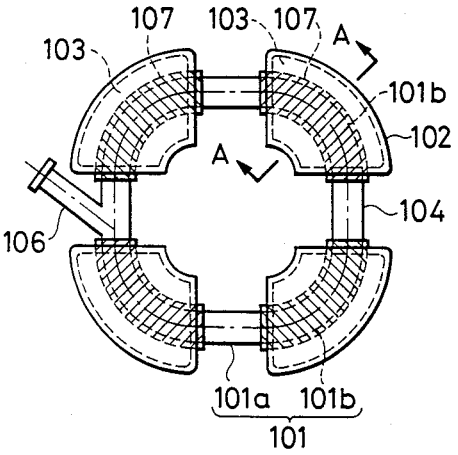
Figure 11B:
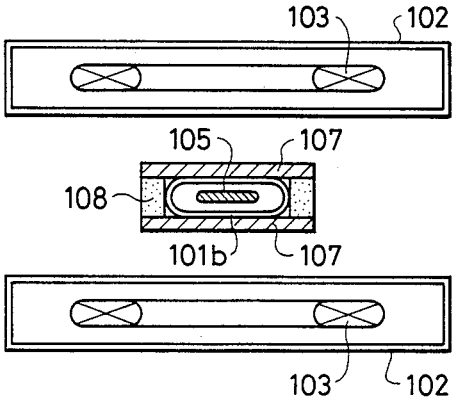
Figure 8:
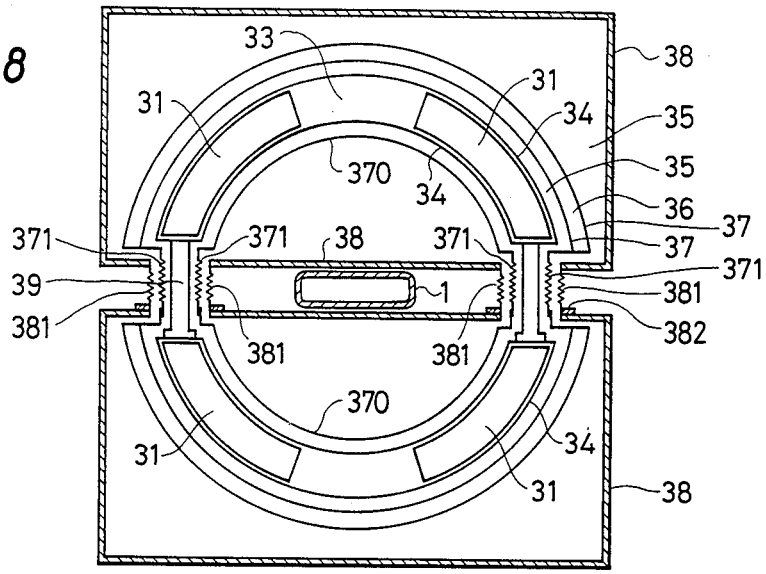
Figure 9A:
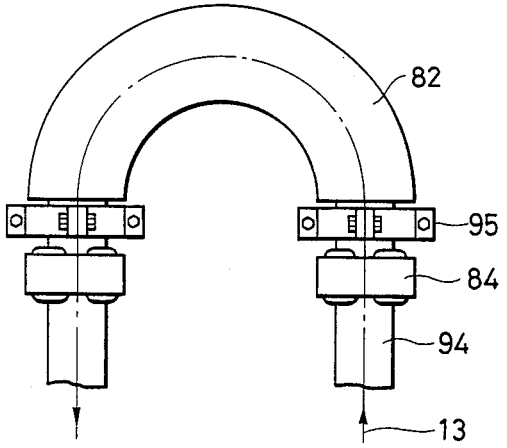
Figure 9B:
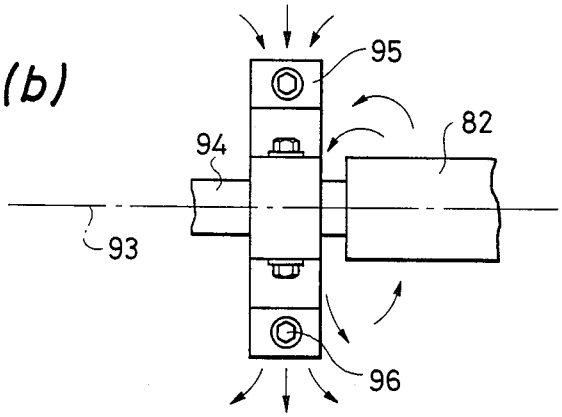
Figure 12:
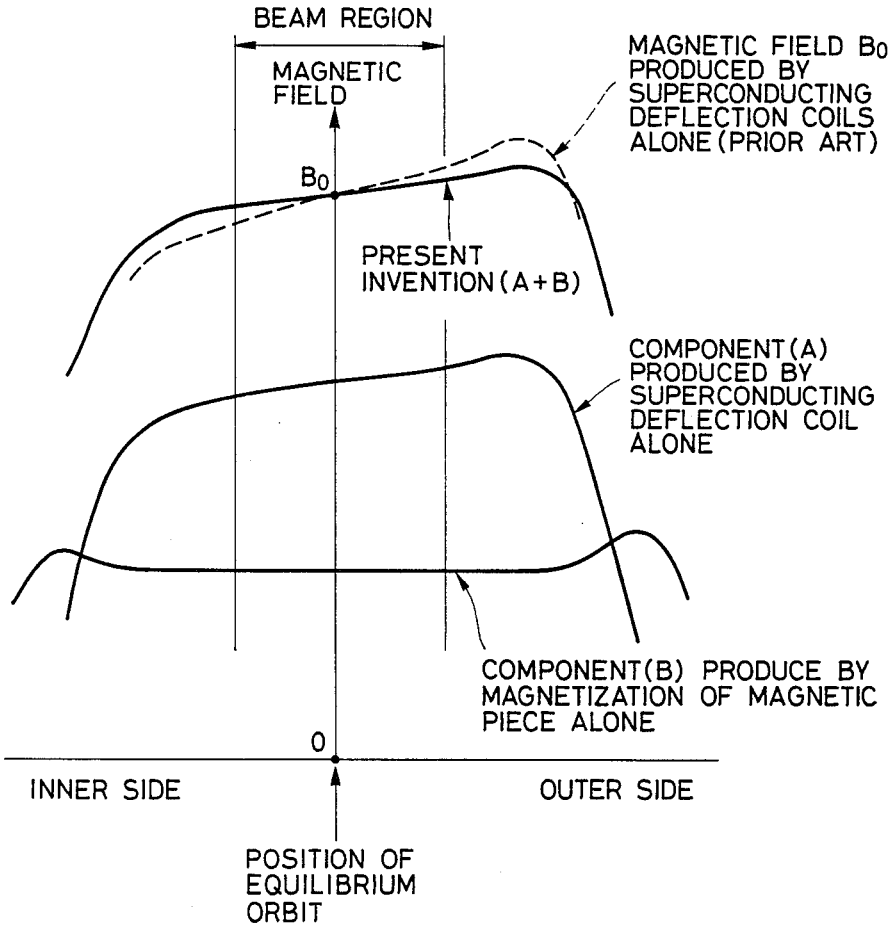
Figure 13A:
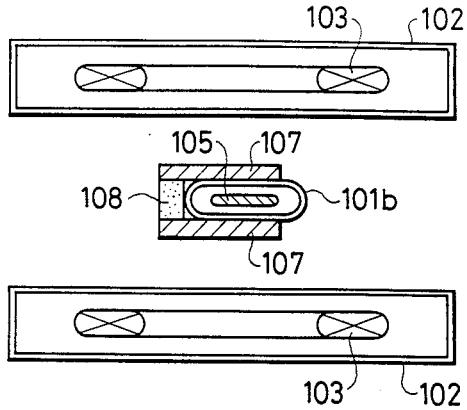
Figure 13B:
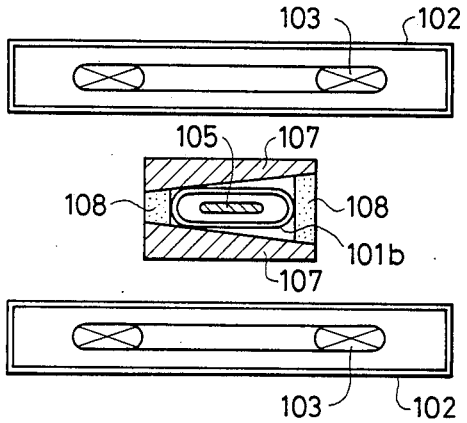

FIGS. 6(*a*) and 6(*b*) show another conventional charged beam apparatus in plan view and partial sectional view, respectively;

FIG. 7 is a perspective view of a superconducting deflection magnet according to one embodiment of the present invention;

FIG. 8 shows a cross section of the magnet of FIG. 7;

FIGS. 9(*a*), 9(*b*) and 9(*c*) show part of a charged beam apparatus in plan view, side view and perspective view, respectively, in accordance with one embodiment of the present invention;

FIG. 10 is a perspective view showing part of a charged beam apparatus according to another embodiment of the present invention;

FIGS. 11(*a*) and 11(*b*) show still another embodiment of the present invention in plan view and enlarged cross section, respectively;

FIG. 12 is a graph showing the advantage of the embodiment of FIG. 11; and FIGS. 13(*a*), 13(*b*), 14(*a*) and 14 (*b*) show a further embodiment of the present invention, respectively.

DESCRIPTION OF THE PREFERRED EMBODIMENT

The preferred embodiments of the present invention are hereinafter described with reference to the accompanying drawings.

FIG. 7 shows a superconducting magnet for use in a charged beam apparatus according to one embodiment of the present invention. In this figure, reference numeral 381 designates an expansible vacuum joint such as bellows, 382 a flange for the joint 381, and 40 a tower with a port 41 for operating a deflection superconducting magnet 3 where a liquid helium inlet, a liquid nitrogen inlet, an evaporated gas outlet, current supply terminals, various instrumentation terminals, etc. are lumped together.

A cross section of the magnet including the expansible vacuum joints is shown in FIG. 8, wherein reference numeral 39 designates a cryogenic support member, 370 a liquid nitrogen heat shield, and 371 an expansible joint liquid nitrogen heat shield which is typically in the for form of bellows or metal gauze. In FIGS. 7 and 8, the parts which are identical to those used, in the prior art apparatus shown in FIGS. 1 to 4 are indicated by the same numerals.

The superconducting coil 31 is accommodated in two separate liquid helium containers 34, one being in the upper position and the other in the lower. The current-supply leads, liquid helium conduits and other components are passed through cryogenic joints (not shown) to be connected to both the upper and lower coils, which are coupled together by cryogenic support members 39 through the walls of the liquid helium containers 34. The cryogenic support members 39 are connected to the liquid helium containers 34 by such means as screws and can be readily disengaged from the latter. The strong attraction created by the electromagnetic force acting between the upper and lower superconducting coils (see the direction of current flow indicated by the arrows in FIG. 2) will be supported by the members 39. This attractive force provides compression at the couplings between the members 39 and the liquid helium containers 34, so that these couplings may be established by simple screwing. The cryogenic support members 39 are surrounded with expansible joints for liquid nitrogen heat shield 371 which establish thermal coupling between upper and lower liquid nitrogen containers 37 and between upper and lower liquid nitrogen heat shields 370. Although not shown, heat shields that are cooled with evaporated helium gas are often provided between the portion 34 (or 39) having the temperature of liquid helium and the portion 37 (or 390 or 371) having the temperature of liquid nitrogen. Expansible vacuum joints 381 are provided around the joints 371 to connect upper and lower vacuum vessels 37 at flanges 382.

The superconducting deflection magnet of the present invention has the above-described construction and can be readily disassembled by the following procedures: first, the expansible vacuum joint flanges 382 are disconnected from the vacuum vessels 38 and the expansible vacuum joints 381 are contracted; then, the expansible joints 371 are disconnected and contracted; finally, the cryogenic support members 39 are disconnected to allow the magnet to be separated into its upper and lower sections. By following these procedures, each of the vacuum chamber for charged beam and the one for synchrotron radiation can be easily repaired or replaced.

The foregoing description assumes the application of the present invention to a storage ring but it should be noted that equally good results are attained even if the invention is applied to synchrotrons and other accelerators that do not employ vacuum chambers for synchrotron radiation.

FIGS. 9(*a*), 9(*b*) and 9(*c*) are partial representations of a charged beam apparatus according to another embodiment of the present invention. In these figures, reference numeral 82 designates a superconducting coil, 84 a quadrupole magnet, 93 an equilibrium orbit for charged particles, 94 a vacuum chamber, 95 an iron shield, and 96 a bolt used in assembling the shield 95. The shield 95 is provided between an end of the superconducting coil 82 and the quadrupole magnet 84 and consists of four parts that are to be assembled with bolts 96. The magnetic lines of force produced are indicated by arrows in FIG. 9(*b*).

Figure 2:
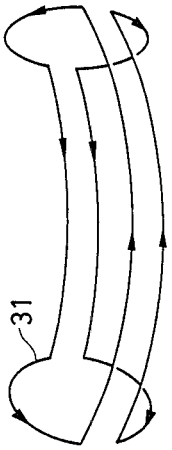
FIG. 2 PRIOR ART
FIG. 2 shows the winding of superconducting coils for the purpose of illustrating the principle of a common superconducting deflection magnet.
Figure 4:
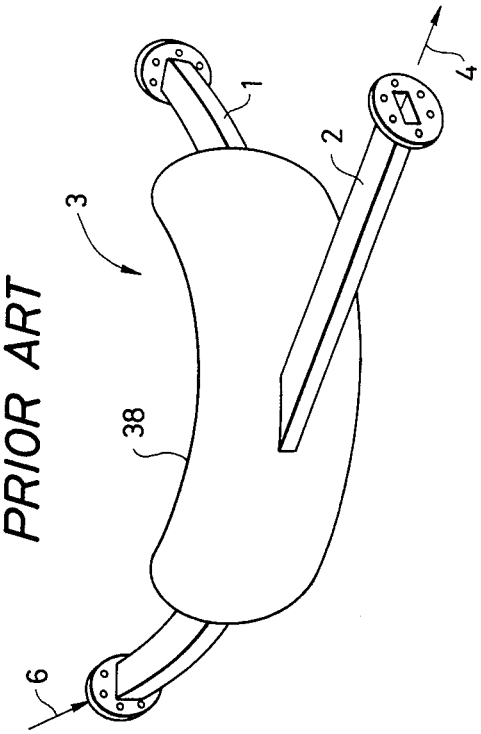
FIG. 4 PRIOR ART
FIG. 4 is a perspective view of the superconducting deflection magnet shown in FIG. 3.
Figure 1:
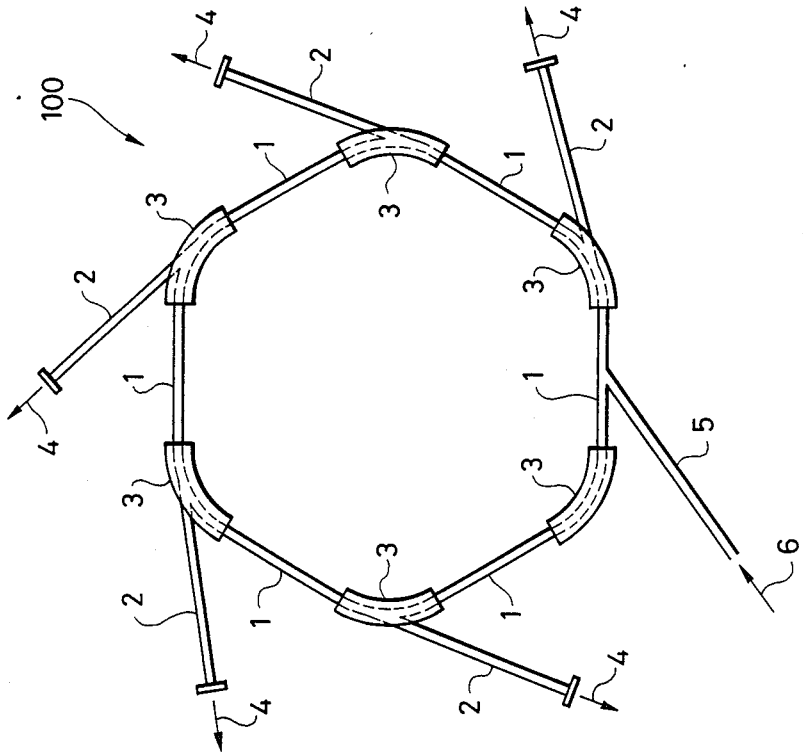
FIG. 1 PRIOR ART
FIG. 1 is a plan view of a storage ring that shows the principle of its operation.
Figure 3:
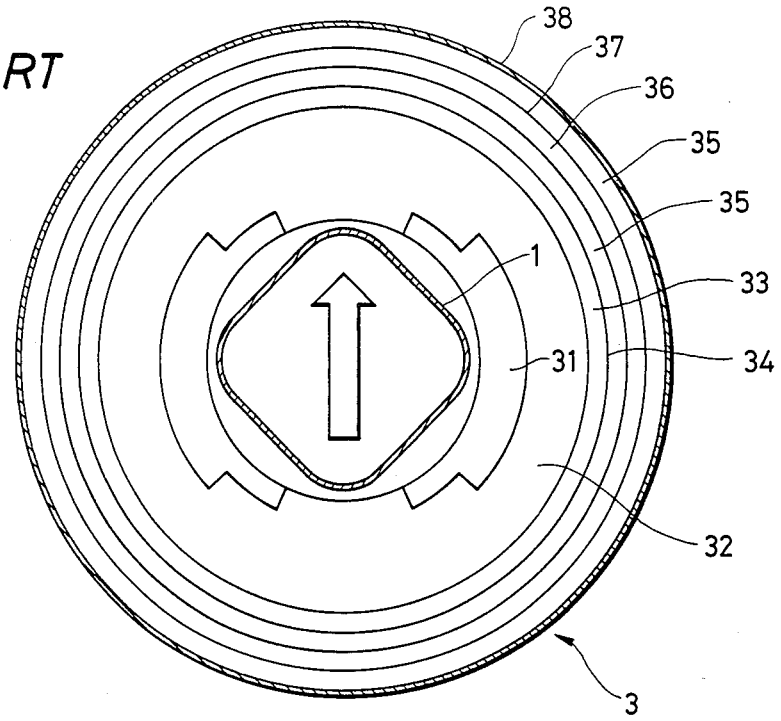
FIG. 3 PRIOR ART
FIG. 3 is a cross-sectional view of a conventional superconducting deflection magnet.
Figure 5:
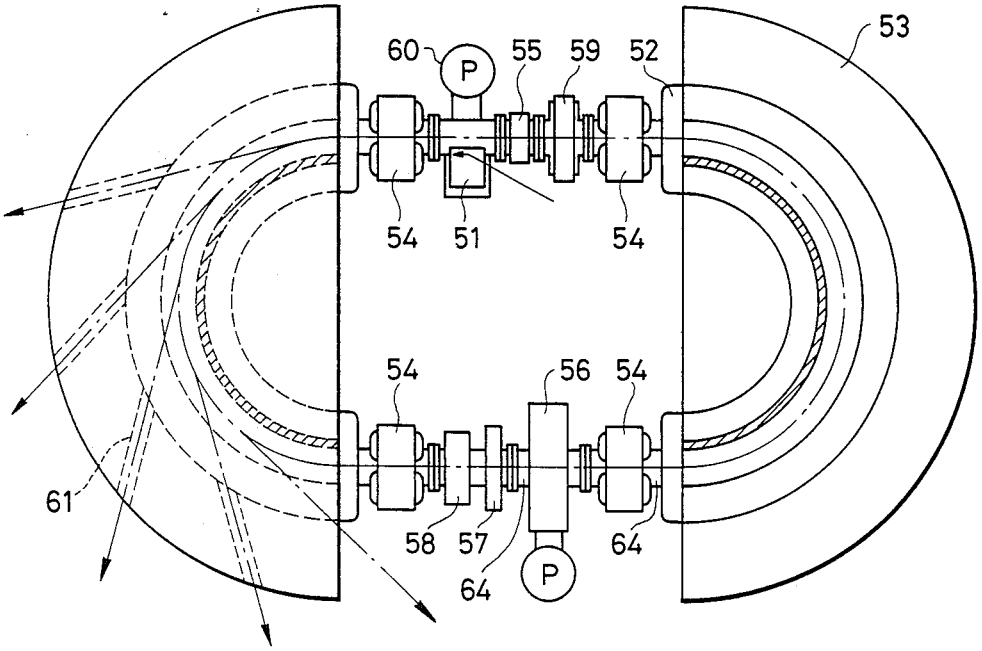
FIG. 5 PRIOR ART
FIG. 5 is a plan view of a conventional charged beam apparatus.

The operation of the apparatus shown in FIG. 9 will be described. When a beam of charged particles is injected, their orbit is first corrected by the quadrupole magnet 84, then bent by a large amount under the influence of the deflection field produced by the superconducting coil 82. In the prior art apparatus shown in FIG. 5, the quantity of leakage flux appearing at both ends of the superconducting coil 52 (i.e., injection and extraction ends of the coil) is large that the uniformity of the fields produced by the quadrupole magnet 54 and other magnets that are located in the neighborhood of these ends will be impaired to preclude the desired correction of the trajectory of the charged particles by the quadrupole magnet 54. The excursion of the charged particles away from their proper orbit will be further increased as a result of their being subjected to unwanted magnetic field at the ends of the superconducting coil 52.

According to the second embodiment of the present invention, the shield 95 is provided at both ends of the superconducting coil 82, so that the field of the quadrupole magnet 84 will not be impaired by the leakage flux at the ends of the coil. In addition, the greater part of the leakage flux will pass through the iron shield 95 to go outside the coil 82 without causing any substantial effect on the charged particles which are to be bent by the coil. Therefore, in the second embodiment of the present invention, the shield 95 is effectively used to prevent the leakage flux from causing any adverse effect on the quadrupole magnet and charged particles, and it becomes possible to allow the charged particles continue to circulate in their correct orbits.

In the embodiment shown, the quadrupole magnet 84 is located adjacent the superconducting coil 82 but, if desired, other magnets such as sextupole or octupole magnets may be provided in this area. In the same embodiment, a gap of certain dimension is provided between the shield 95 and either end of the superconducting coil 82 but, alternatively, the shield may be directly attached to an end of the superconducting coil so that no gap will be left between the two components. This alternative modification is shown in FIG. 10, wherein reference numerals 82, 93 and 94 denote the same components as shown in FIG. 9 and reference numeral 95*a* denotes the shield which is directly attached to an end of the superconducting coil. In the second embodiment under discussion, the shield is shown to be detachable but it may be an integral part of the vacuum chamber 94. In the embodiment shown in FIG. 9, the shield 95 is an assembly of four parts but it may be composed of any number of components.

FIGS. 11(*a*) and 11(*b*) show a charged beam apparatus according to a third embodiment of the present invention. In these figures, reference numeral 107 designates a magnetic piece that is formed both above and below the vacuum chamber 101 and which is situated between the upper and lower superconducting deflection coils 103, and 108 a support for the magnetic pieces 107 that is situated therebetween and which is made of a non-magnetic material. Being arranged in this way, the magnetic pieces 107 serve to provide a uniform deflecting magnetic field throughout the charged beam region 105, as will be understood from the following explanation.

The magnetic pieces 107 will exhibit their intended effects so long as they are made of common soft steels, pure iron or any other similar ferromagnetic materials. However, materials having pronounced hysteresis characteristics (e.g. large coercive forces or residual fluxes) are not suitable. The magnetic pieces may be formed of materials that are entirely the same as those which are used as iron yokes or magnetic poles in conventional normal conducting electromagnets.

Since the magnetic piece 107 is exposed to the magnetic field created by the superconducting deflection coil 103, it is magnetized to the saturation magnetization, the value of which is dependent on the material of which it is made (about 2.1 T for common iron or pure iron). Since a substantially uniform flux distribution is produced within a magnetized material, it will be readily understood that the distribution of magnetization in the magnetic piece 107 is uniform except at the corners, as shown by (B) in FIG. 12. This will produce an additional component of magnetic field that is substantially uniform throughout the charged beam region 105. The magnetic flux distribution finally obtained in the charged beam region 105 according to the third embodiment of the present invention consists of the component (B) superposed on the component (A) produced by the superconducting deflection coil 103 in the absence of any magnetic piece; therefore, the uniformity of the composite magnetic field is improved by an amount commensurate with the substantially uniform component (B). This relationship is shown schematically in FIG. 12, wherein the dashed curve represents the data obtained when a magnetic field Bo is produced by employing superconducting deflection coils alone as in the prior art.

In the embodiment discussed above, the magnetic piece 107 is fixed both above and below the vacuum chamber 101 but equally good results will be attained if the magnetic piece is fixed to the electromagnet. For attaining maximum size reduction, the magnetic piece 107 is preferably disposed in the immediate vicinity of the vacuum chamber as shown in FIG. 11(*b*).

FIG. 13(*a*) and 13(*b*) illustrate two modifications of the embodiment shown in FIGS. 11(*a*) and 11(*b*). In FIG. 13(*a*), the magnetic piece 107 is offset slightly inwardly with respect to the beam center such that the declining portion of the flux distribution curve shown in FIG. 12 will be shifted upward to provide a more uniform distribution. The same effect will be attained by the modification shown in FIG. 13(*b*), wherein the height of the support 108 on one side of the vacuum chamber is made different from the height of the support on the other side, so that the distance between the two magnetic pieces 107 will be asymmetric with respect to the beam center.

The two modifications shown in FIGS. 13(*a*) and 13(*b*) will enable the creation of a uniform magnetic field in space by freely adjusting the lateral offset of the magnetic pieces 107 from the center of the beam or the distance between these pieces in accordance with the specific design of the deflection electromagnet. In short, these modifications are intended to enhance the advantage of the present invention described with reference to FIG. 12.

Figure 14A:
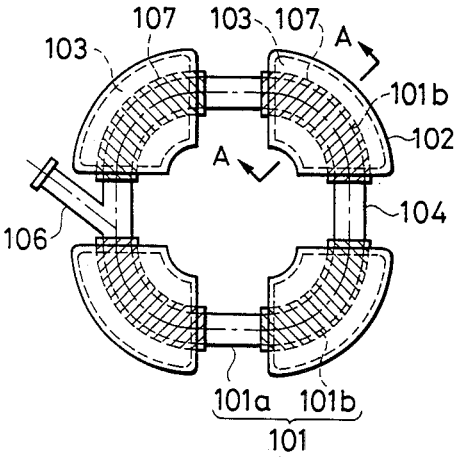
Figure 14B:
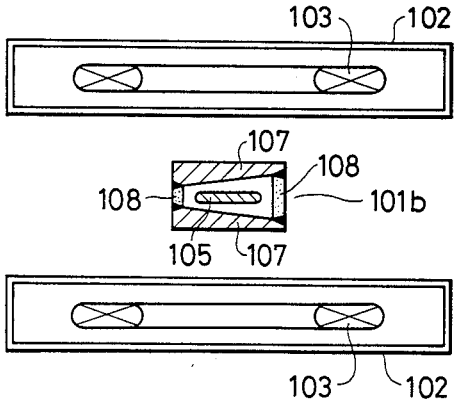

The aforementioned effects can also be attained by another modification of the embodiment shown in FIGS. 14(*a*) and 14(*b*). Being depicted in FIGS. 14(*a*) and 14(*b*), this modification is characterized by forming the vacuum chamber 101*b* with magnetic pieces 107 and supports 108 and has the advantage that a uniform field distribution can be attained in an area that is closer to the beam space than in the previous modifications. As a further advantage, the layout of the magnetic pieces 107 is not limited by the dimensions of the space between the two deflection electromagnets. In this modification shown in FIG. 14, the magnetic pieces 107 are preferably welded to the supports 108 in order to establish a high-vacuum seal.

As described above, in accordance with the first aspect of the present invention, a superconducting deflection magnet is divided into an upper and a lower section and the two sections are coupled as a single unit by means of cryogenic support members and expansion joints. Because of this construction, the magnet can be readily disassembled and separated into its upper and lower sections, thereby allowing vacuum chambers for charged beam or synchrotron radiation to be easily removed from a storage ring in preparation for their repair or replacement.

In accordance with the second aspect of the present invention, a shield is provided at both ends of a deflection electromagnet in a charged beam apparatus so as to block any leakage flux that will occur from the magnet. The shield will prevent such leakage flux from causing any adverse effects on other magnets and charged particles and it becomes possible to confine the charged particles such that they will continue to circulate in their proper orbits.

According to the third aspect of the present invention, a magnetic piece is provided only in limited areas (i.e., above and below) of the vacuum chamber and this is an effective way of producing a uniform magnetic field for superconducting deflection coils at low cost without causing any substantial increase in weight, size or heat input. By making use of this concept, a charged beam apparatus featuring a prolonged beam life time can be realized.

What is claimed is:

1. A charged beam apparatus, comprising: vacuum vessels for accommodating superconducting coils in a heat-insulating manner; a charged beam vacuum chamber providing a passage for a charged beam; and a vacuum chamber for synchrotron radiation that is coupled to said charged beam vacuum chamber and through which is passed the synchrotron radiation produced by said charged beam when it is bent by said superconducting coils, said vacuum vessels being detachable from said charged beam vacuum chamber.

2. A charged beam apparatus according to claim 1, further comprising: cryogenic support member for connecting said superconducting coils in liquid helium containers through the walls of said containers; an expansible heat shield joint disposed around said cryogenic support members and coupling an upper and a lower heat shield; and an expansible vacuum joint disposed around said expansible heat shielding and coupling said vacuum vessels.

3. A charged beam apparatus according to claim 1, further comprising a shield provided at both ends of each of said superconducting coils in order to block any leakage flux coming from said coils.

4. A charged beam apparatus according to claim 1, further comprising a plurality of magnetic pieces provided between each of said superconducting coils and said charged beam vacuum chamber in order to correct the magnetic flux distribution in said charged beam vacuum chamber such that it will be flat across said chamber in its radial direction.

5. A charged beam apparatus according to claim 4, wherein said magnetic pieces are fixed to the two principal surfaces of said charged beam vacuum chamber.

6. A charged beam apparatus according to claim 4, wherein said charged beam vacuum chamber is partly formed of a magnetic material in its cross section.

7. A charged beam apparatus according to claim 4, wherein said magnetic pieces are formed of upper and lower pieces in such a manner that the distance between said upper and lower pieces varies in the radial direction of said charged beam vacuum chamber.

8. A charged beam apparatus according to claim 4, wherein said magnetic pieces are disposed above and below the charged beam vacuum chamber in a manner that is symmetrical with respect to the horizontal plane through the center of said chamber but which is asymmetrical with respect to the center of an equilibrium orbit of the charged beam in its radial direction.

* * * * *